US009116471B2

(12) United States Patent
Inuzuka

(10) Patent No.: US 9,116,471 B2
(45) Date of Patent: Aug. 25, 2015

(54) IMAGE FORMING APPARATUS

(71) Applicant: CANON KABUSHIKI KAISHA, Tokyo (JP)

(72) Inventor: Tomoya Inuzuka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/480,992

(22) Filed: Sep. 9, 2014

(65) Prior Publication Data

US 2015/0086239 A1 Mar. 26, 2015

(30) Foreign Application Priority Data

Sep. 20, 2013 (JP) ..... 2013-195151

(51) Int. Cl.
*G03G 15/16* (2006.01)
*G03G 15/00* (2006.01)

(52) U.S. Cl.
CPC ..... *G03G 15/1615* (2013.01); *G03G 15/50* (2013.01)

(58) Field of Classification Search
CPC ..... G03G 15/1615; G03G 15/50
See application file for complete search history.

(56) References Cited

U.S. PATENT DOCUMENTS 6,529,695 B2 * 3/2003 Katayanagi et al. ..... 399/49
8,811,834 B2 8/2014 Yoshida
2005/0008381 A1 * 1/2005 Aono et al. ..... 399/45
2006/0024076 A1 * 2/2006 Kato et al. ..... 399/49
2010/0303512 A1 * 12/2010 Kamekura et al. ..... 399/301
2012/0230706 A1 * 9/2012 Yoshida ..... 399/27
2013/0077984 A1 3/2013 Yoshida

FOREIGN PATENT DOCUMENTS

JP 2002-214940 A 7/2002
JP 2012-198496 A 10/2012

* cited by examiner

*Primary Examiner* — Sandra Brase

(74) *Attorney, Agent, or Firm* — Fitzpatrick, Cella, Harper & Scinto

(57) ABSTRACT

A control part provided in an image forming apparatus controls a moving unit so as to cause a secondary transfer rotary member to move from an intermediate position to an abutment position at a first moving speed in the case of bringing the secondary transfer rotary member into abutment against an intermediate transfer member during an exposure period or a primary transfer period, and to cause the secondary transfer rotary member to move from a separation position to the abutment position at a second moving speed higher than the first moving speed in the case of bringing the secondary transfer rotary member into abutment against the intermediate transfer member during a period other than the exposure period and the primary transfer period. Thus, the productivity can be prevented from being degraded while a load change at a time of the abutment of the secondary transfer rotary member is reduced.

5 Claims, 9 Drawing Sheets

IMAGE FORMING APPARATUS

BACKGROUND OF THE INVENTION

1. Field of the Invention

The present invention relates to an image forming apparatus such as a printer, a fax machine, and a copying machine, employing an electrophotographic system or an electrostatic recording system.

2. Description of the Related Art

Hitherto, there have been known various image forming apparatus employing an electrophotographic system or an electrostatic recording system in an image forming process as described below. As an example thereof, there is given an image forming apparatus of an intermediate transfer tandem system in which a plurality of process cartridges are arranged in a row in a rotational direction of an intermediate transfer belt tensioned rotatably, and a color image is formed via the intermediate transfer belt.

As the image forming apparatus of an intermediate transfer tandem system, there is an image forming apparatus in which an endless intermediate transfer belt (intermediate transfer member) is tensioned by a plurality of tension rollers including a drive roller. This image forming apparatus includes a primary transfer portion formed of a photosensitive drum and a primary transfer roller, which are arranged to be opposed to each other at positions capable of interposing the intermediate transfer belt therebetween in a region between the two tension rollers. This image forming apparatus further includes a secondary transfer portion formed of a secondary transfer inner roller and a secondary transfer outer roller (secondary transfer rotary member), which is capable of being brought into abutment against and being separated from the secondary transfer inner roller. The secondary transfer inner roller and the secondary transfer outer roller are arranged to be opposed to each other so as to interpose the intermediate transfer belt therebetween on a downstream side of the intermediate transfer belt in a rotational direction.

In this image forming apparatus, in general, the secondary transfer outer roller is brought into abutment against the intermediate transfer belt during secondary transfer, and the secondary transfer outer roller is separated from the intermediate transfer belt during periods other than the printing operation. This enhances an inserting and extracting property of a sheet (recording material) conveyance unit during jam processing and apparatus maintenance, and hence prevents damages to the intermediate transfer belt caused by paper jam.

In most cases, in order to stably obtain intended image density, this image forming apparatus has a configuration in which a plurality of kinds of detection patterns (correction patches) to be used for adjusting density and correcting color registration are formed on the intermediate transfer belt, and the density is corrected by detecting the patterns with a sensor. An image forming apparatus disclosed in Japanese Patent Application Laid-Open No. 2012-198496 is configured as described below in order to prevent the secondary transfer outer roller from being contaminated with the detection patterns when the detection patterns are formed on the intermediate transfer belt between sheets (between recording materials to be conveyed) during printing. Specifically, the secondary transfer outer roller is separated from the intermediate transfer belt while the detection patterns are passing through the secondary transfer portion so as to prevent the secondary transfer outer roller from being contaminated with the detection patterns.

However, in the configuration in which the contamination of the secondary transfer outer roller is prevented by separating the secondary transfer outer roller from the intermediate transfer belt as described in Japanese Patent Application Laid-Open No. 2012-198496, a load change, which is caused when the separated secondary transfer outer roller is again brought into abutment against the intermediate transfer belt, may cause the following adverse effect. That is, the load change may propagate to the photosensitive drum or the intermediate transfer belt during image formation to cause an image defect such as an image streak due to shock.

The above-mentioned problem can be solved by starting image formation after the completion of an operation of bringing the second transfer outer roller into abutment against the intermediate transfer belt. However, in this case, the productivity is degraded due to the delay of the start of image formation. Further, there is also considered a method of reducing a load change by decreasing a moving speed uniformly at a time when the secondary transfer outer roller is brought into abutment against the intermediate transfer belt. However, in this case, the time period required for bringing the separated secondary transfer outer roller into abutment against the intermediate transfer belt becomes long at all times, resulting in difficulty in preventing degradation in productivity.

SUMMARY OF THE INVENTION

According to one embodiment of the present invention, there is provided an image forming apparatus, including: a rotatable photosensitive member; an exposure unit exposing the photosensitive member, which has been charged, so as to form a latent image; a developing unit developing the latent image formed on the photosensitive drum so as to form a toner image; a movable intermediate transfer member; a primary transfer roller primarily transferring the toner image, which is formed on the photosensitive member, from the photosensitive member onto the intermediate transfer member in a primary transfer portion in which the intermediate transfer member is brought into abutment against the photosensitive member; a secondary transfer unit having a secondary transfer roller that secondarily transfers the toner image, which is primarily transferred onto the intermediate transfer member, onto a recording material in a secondary transfer portion in which the secondary transfer roller is brought into abutment against the intermediate transfer member, the secondary transfer unit capable of being brought into abutment against and separated from the intermediate transfer member, and capable of being removed from and mounted on an apparatus body while being separated from the intermediate transfer member; a moving mechanism moving the secondary transfer unit to an abutment position, a separation position and an intermediate position under a state in which the secondary transfer unit is mounted on the apparatus body, wherein the secondary transfer unit is brought into abutment against the intermediate transfer member in the abutment position, the secondary transfer unit is capable of being removed from and mounted on the apparatus body in the separation position, the secondary transfer unit is separated from the intermediate transfer member in the separation position, and the intermediate position is between the separation position and the abutment position; and a control unit configured to control the moving mechanism so as to cause the secondary transfer unit to move from the intermediate position to the abutment position at a first moving speed in a case where the secondary transfer unit is to be brought into abutment against the intermediate transfer member during at least one of an exposure period or a primary transfer period, and to cause the secondary transfer unit to move from the separation position to the abutment position at a second moving speed higher than the first moving speed in a case where the secondary transfer unit is to be brought into abutment against the intermediate transfer member during a period other than the exposure period and the primary transfer period.

Further features of the present invention will become apparent from the following description of exemplary embodiments with reference to the attached drawings.

DESCRIPTION OF THE EMBODIMENTS

Now, a first embodiment of the present invention is described in detail with reference to the drawings. The same reference symbols denote the same or corresponding parts throughout the drawings. In this embodiment, main parts related to the formation and transfer of a toner image are mainly described. However, the present invention can be added with required appliances, equipment, and housing structures so as to be carried out in various applications such as printers, various printing machines, copying machines, fax machines, and multifunction peripherals.

[Entire Configuration of Image Forming Apparatus]

Figure 1:
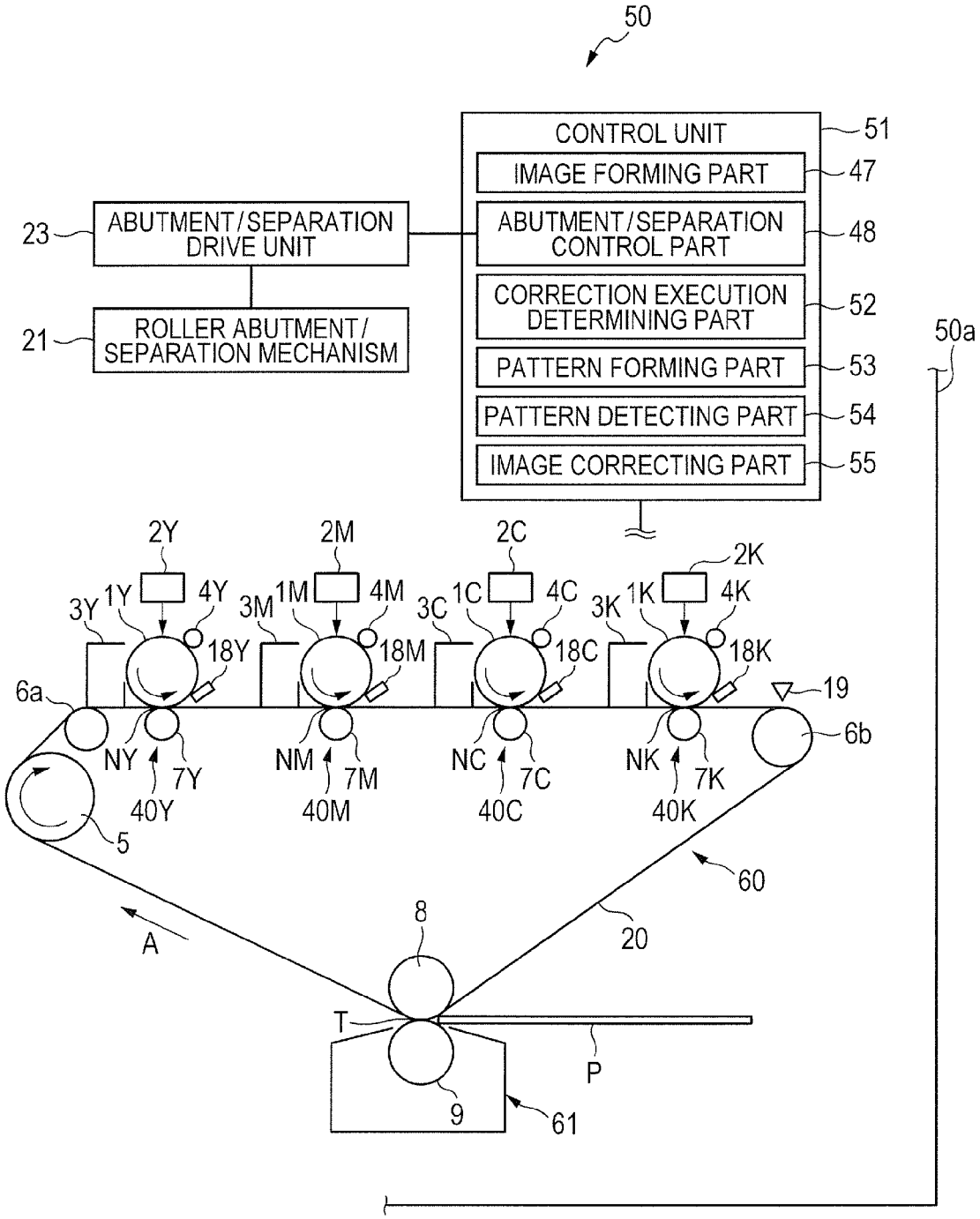
FIG. 1 is a schematic sectional view schematically illustrating a part of an image forming apparatus according to a first embodiment of the present invention.

First, referring to FIG. 1, an image forming apparatus according to this embodiment is described. FIG. 1 is a schematic sectional view illustrating a schematic configuration of an image forming apparatus 50 such as a full-color printer of an intermediate transfer system and tandem type according to this embodiment.

As illustrated in FIG. 1, the image forming apparatus 50 includes an apparatus body 50*a*. In the apparatus body 50*a*, an intermediate transfer belt unit 60 having an intermediate transfer belt (ITB) 20 serving as a rotatable intermediate transfer member is arranged. The image forming apparatus 50 includes image forming units 40Y, 40M, 40C, 40K arranged successively from an upstream side in a conveyance direction along an upper conveyance surface of the intermediate transfer belt 20. The image forming units 40Y to 40K form toner images of respective colors of yellow (Y), magenta (M), cyan (C), and black (Bk) onto the intermediate transfer belt 20 which is driven and conveyed.

The image forming units 40Y to 40K respectively include drum-shaped electrophotographic photosensitive members (hereinafter referred to as "photosensitive drums") 1Y, 1M, 1C, 1K serving as rotatable image bearing members. The photosensitive drums 1Y, 1M, 1C serving as color (CL) photosensitive drums and the photosensitive drum 1K are respectively configured so as to be driven and rotated in a counterclockwise direction in FIG. 1.

The intermediate transfer belt unit 60 includes a drive roller 5, tension rollers 6*a*, 6*b*, and a secondary transfer inner roller 8 respectively arranged so as to satisfy a predetermined positional relationship. The intermediate transfer belt 20, which is an endless belt, is tensioned (supported) rotatably in a circumferential direction (direction of the arrow A) by the drive roller 5, the tension rollers 6*a*, 6*b*, and the secondary transfer inner roller 8. Tension (tensile strength) to an outside is applied to the intermediate transfer belt 20 by the tension rollers 6*a* and 6*b*.

Primary transfer rollers 7Y, 7M, 7C, 7K serving as primary transfer parts are arranged between the tension rollers 6*a* and 6*b* on an inner circumferential side of the intermediate transfer belt 20. The primary transfer rollers 7Y to 7K primarily transfer the toner images formed by developing devices 3Y, 3M, 3C, 3K from the photosensitive drums 1Y to 1K onto the intermediate transfer belt 20 in primary transfer nip portions (primary transfer portions) NY, NM, NC, NK between the intermediate transfer belt 20 and the photosensitive drums 1Y to 1K.

A transfer bias is applied to the primary transfer rollers 7Y to 7K by a bias application part (not shown). The photosensitive drums 1Y to 1K are respectively arranged at positions respectively opposed to the primary transfer rollers 7Y to 7K with the intermediate transfer belt 20 interposed therebetween. A back surface side (inner surface side) of the intermediate transfer belt 20 is pressurized by the primary transfer rollers 7Y to 7K, and a front surface side thereof is held in abutment against the photosensitive drums 1Y to 1K in the respective image forming units 40Y to 40K.

The primary transfer nip portions NY, NM, NC, NK serving as the primary transfer portions are respectively formed between the photosensitive drums 1Y, 1M, 1C, 1K and the intermediate transfer belt 20. The intermediate transfer belt 20 is rotated in the same direction as the drive roller 5 due to the rotation in a clockwise direction of the drive roller 5. The rotational speed of the intermediate transfer belt 20 is set to be substantially the same as the rotational speed (process speed) of the respective photosensitive drums 1Y to 1K.

Charging rollers 4Y, 4M, 4C, 4K serving as charging parts and scanner units 2Y, 2M, 2C, 2K serving as exposure parts are successively arranged on the respective peripheries of the photosensitive drums 1Y to 1K in each rotational direction of the photosensitive drums 1Y to 1K. The scanner units 2Y, 2M, 2C, 2K respectively form latent images by exposing the charged photosensitive drums 1Y, 1M, 1C, 1K. The developing devices 3Y, 3M, 3C, 3K serving as developing parts and photosensitive member cleaning blades 18Y, 18M, 18C, 18K are arranged on the respective peripheries of the photosensitive drums 1Y to 1K. The developing devices 3Y, 3M, 3C, 3K respectively develop the latent images (electrostatic latent images) formed on the photosensitive drums 1Y, 1M, 1C, 1K as toner images.

The scanner units 2Y, 2M, 2C, 2K respectively receive image signals of yellow, magenta, cyan, and black, and irradiate the respective surfaces of the photosensitive drums 1Y, 1M, 1C, 1K with laser light in accordance with the image signals so as to neutralize charges and form the electrostatic latent images.

A secondary transfer outer roller 9 serving as a secondary transfer rotary member is arranged on the surface of the intermediate transfer belt 20 at a position opposed to the secondary transfer inner roller 8. The secondary transfer outer roller 9 is provided in a secondary transfer unit 61 (see also FIG. 3) configured removably with respect to the apparatus body 50*a*. The secondary transfer outer roller 9 and the secondary transfer inner roller 8 interpose the intermediate transfer belt 20 therebetween, and a secondary transfer nip portion T serving as a secondary transfer portion is formed between the secondary transfer outer roller 9 and the intermediate transfer belt 20. The secondary transfer outer roller 9 is brought into abutment against the intermediate transfer belt 20 so as to form the secondary transfer nip portion (secondary transfer portion) T, and secondarily transfer the toner images, which are primarily transferred onto the intermediate transfer belt 20, onto a recording material P conveyed to the secondary transfer nip portion T.

In the secondary transfer nip portion T, the toner images formed on the intermediate transfer belt 20 are secondarily transferred onto the recording material (sheet) P fed from a sheet feed unit (not shown). A positive bias is applied to the secondary transfer outer roller 9. The positive bias is applied to the secondary transfer nip portion (secondary transfer portion) T through intermediation of the secondary transfer outer roller 9. Thus, the toner images of 4 colors on the intermediate transfer belt are secondarily transferred onto the recording material P conveyed by a registration roller pair (not shown). The sheet feed unit is provided in a lower portion of the apparatus body and includes a sheet feed cassette (not shown) in which the recording materials to be used for forming images are stacked. The recording material is successively fed from the sheet feed unit by sheet feed rollers (not shown) and the like, and is conveyed to the registration roller pair.

A fixing device having a fixing roller and a pressure roller (not shown) is provided on a downstream side of the secondary transfer nip portion (secondary transfer portion) T in a recording material conveyance direction. On a downstream side of the fixing device, a delivery roller pair (not shown) and a delivery tray (not shown) are provided. The recording material P, onto which the toner images have been secondarily transferred in the secondary transfer nip portion T, is conveyed to a fixing nip portion provided between the fixing roller and the pressure roller, and heated and pressurized by the fixing roller and the pressure roller, with the result that the toner images are melted and fixed onto the surface of the recording material P.

Above the tension roller 6*b*, a pattern detection sensor 19 is arranged at a position opposed to the intermediate transfer belt 20 on an outer circumference of the tension roller 6*b*.

[Function of Image Forming Apparatus]

In the image forming apparatus 50 having the above-mentioned configuration, a yellow toner image is formed onto the photosensitive drum 1Y in the image forming unit 40Y and transferred onto the intermediate transfer belt 20. In the image forming unit 40M, a magenta toner image is formed by the same procedure as that of the image forming unit 40Y and transferred onto the intermediate transfer belt (intermediate transfer member) 20 so as to be superimposed on the yellow toner image. In the image forming units 40C, 40K, a cyan toner image and a black toner image are formed by the same procedure as that of the image forming unit 40Y and successively transferred onto the intermediate transfer belt 20 so as to be superimposed.

The toner images of 4 colors borne on the intermediate transfer belt 20 are conveyed to the secondary transfer nip portion (secondary transfer portion) T and secondarily transferred onto the recording material P at a time. The recording material P onto which the toner images of 4 colors have been secondarily transferred is separated from the intermediate transfer belt 20 and fed to the fixing device (not shown). The recording material P is heated and pressurized in the fixing nip portion of the fixing device, and the image is fixed onto the surface of the recording material P due to the melting of the toner. After that, the recording material P is delivered to the delivery tray through intermediation of the delivery roller pair (not shown).

The image forming units 40Y to 40K are configured substantially the same except that the colors of the toner to be used in the respective developing devices 3Y to 3K are different (i.e., yellow, magenta, cyan, and black). In the following, the process of forming a toner image in the black image forming unit 40K is described, and the repeated descriptions regarding the other image forming units 40Y, 40M, 40C are omitted.

The photosensitive drum 1K in the image forming unit 40K has a photosensitive layer having a negative charging polarity on the surface thereof and rotates in an arrow direction at a predetermined process speed. The charging roller 4K is supplied with an oscillation voltage in which an AC voltage is superimposed on a negative DC voltage so as to negatively charge the surface of the photosensitive drum 1K. The scanner unit 2K scans with an ON-OFF modified laser beam from scanning line image data obtained by developing a black decomposed color image through use of a rotary mirror and writes an electrostatic latent image of the image onto the surface of the photosensitive drum 1K.

The developing device 3K subjects a two-component developer containing a non-magnetic toner having a negative charging polarity and a magnetic carrier to triboelectric charging, and causes a developing sleeve (not shown) to carry the two-component developer thereon and convey the two-component developer to an opposed part with respect to the photosensitive drum 1K. When the oscillation voltage in which an AC voltage is superimposed on a negative DC voltage is applied to the developing sleeve, the negatively charged toner is transferred onto an exposure part of the photosensitive drum 1K, which has been relatively positively charged, with the result that the electrostatic latent image is subjected to reversal development.

When a positive DC voltage is applied to the primary transfer nip portion (primary transfer portion) NK provided between the photosensitive drum 1K and the intermediate transfer belt 20, the primary transfer roller 7K primarily transfers the toner image borne on the photosensitive drum 1K onto the intermediate transfer belt 20. After that, a transfer residual toner remaining on the photosensitive drum 1K is collected by the photosensitive member cleaning blade (not shown), which is brought into abutment against the photosensitive drum 1K.

When a positive DC voltage is applied to the secondary transfer outer roller 9, the secondary transfer outer roller 9 secondarily transfers a full-color toner image borne on the intermediate transfer belt 20 onto the recording material P conveyed to the secondary transfer nip portion T provided between the outer surface of the intermediate transfer belt 20 and the secondary transfer outer roller 9. Then, a belt cleaning blade (not shown) is brought into abutment against the intermediate transfer belt 20, with the result that the transfer residual toner remaining on the intermediate transfer belt 20 is collected.

[Image Correction Control and Abutment/Separation Operation Control]

Next, image correction control and abutment/separation operation control in this embodiment are described. As illustrated in FIG. 1, the image forming apparatus 50 includes a control unit 51 including a read-only memory (ROM), a random-access memory (RAM), and a central processing unit (CPU).

The control unit 51 includes an image forming part 47, an abutment/separation control part 48 serving as a control part, a correction execution determining part 52, a pattern forming part 53, a pattern detecting part 54, and an image correcting part 55.

The image forming part 47 outputs an instruction based on input information and the like from an operation unit (not shown) provided in the apparatus body to each part and causes each part to perform image forming processing using the image forming units 40Y to 40K and the like.

A roller abutment/separation mechanism 21 is connected to the abutment/separation control part (control part) 48 through intermediation of an abutment/separation drive unit 23. The roller abutment/separation mechanism 21 and the abutment/separation drive unit 23 are a moving unit for moving the secondary transfer outer roller 9 to an abutment position, a standby position, or a separation position while the secondary transfer unit 61 is mounted on the apparatus body 50*a*. The abutment position (see FIG. 4A) is a position at which the secondary transfer outer roller 9 is brought into abutment against the intermediate transfer belt 20. The separation position (see FIG. 4C) is a position at which the secondary transfer unit 61 can be mounted on or removed from the apparatus body 50*a* and at which the secondary transfer outer roller 9 is separated from the intermediate transfer belt 20 to such a degree as not to be held in contact with the intermediate transfer belt 20 during the process in which the secondary transfer unit 61 is mounted on or removed from the apparatus body 50*a*. The standby position (see FIG. 4B) is an intermediate position between the separation position and the abutment position, in which the secondary transfer outer roller 9 is separated from the intermediate transfer belt 20 between the separation position and the abutment position.

The abutment/separation control part 48 controls the abutment/separation drive unit 23 and the roller abutment/separation mechanism 21 so as to move the secondary transfer outer roller 9 to the abutment position, the separation position, or the standby position. That is, the abutment/separation control part 48 controls the moving unit (21, 23) so that a first moving speed becomes lower than a second moving speed during at least one of the exposure period by the scanner units 2Y to 2K and the primary transfer period in which toner images are transferred in the primary transfer nip portions NY to NK. A first moving speed V1 is a speed at which the secondary transfer outer roller 9 is brought into abutment against the intermediate transfer belt 20 from the standby position during image formation using at least one of the scanner units 2Y to 2K and the primary transfer nip portions NY to NK. A second moving speed V2 is a speed at which the secondary transfer outer roller 9 is brought into abutment against the intermediate transfer belt 20 from the separation position in the cases other than the image formation. That is, the abutment/separation control part 48 moves the secondary transfer outer roller 9 at the first moving speed from the standby position to the abutment position in the case of bringing the secondary transfer outer roller 9 into abutment against the intermediate transfer belt 20 during at least one of the exposure period by the scanner units 2Y to 2K and the primary transfer period in the primary transfer nip portions NY to NK. Further, the abutment/separation control part 48 moves the secondary transfer outer roller 9 at the second moving speed from the separation position to the abutment position in the case of bringing the secondary transfer outer roller 9 into abutment against the intermediate transfer belt 20 during the periods other than at least one of the above-mentioned periods. The abutment/separation control part 48 controls the roller abutment/separation mechanism 21 and the abutment/separation drive unit 23 serving as the moving unit so that the first moving speed becomes lower than the second moving speed.

In this embodiment, positions at which the secondary transfer outer roller 9 is separated from the abutment position are set at the standby position (intermediate position) and the separation position farther from the intermediate transfer belt 20 than the standby position. Therefore, during the image formation such as the exposure period and the primary transfer period which is liable to become a factor for image defects, the secondary transfer outer roller 9 can be moved and brought into abutment with the intermediate transfer belt 20 at the relatively low first moving speed V1 from the relatively close standby position. Consequently, a load change at a time of the abutment of the secondary transfer outer roller 9 can be reduced.

On the other hand, in the case of the periods other than the exposure period and the primary transfer period during which it is not necessary to consider image defects, that is, in the case of the periods other than the image formation, the secondary transfer outer roller 9 is moved as follows. That is, the secondary transfer outer roller 9, which has been moved to the separation position at a time when the secondary transfer unit 61 is removed from the apparatus body 50*a*, is moved from the separation position farther than the standby position at the second moving speed after the secondary transfer unit 61 is mounted. Consequently, the productivity can be prevented from being degraded.

The abutment/separation control part 48 controls the abutment/separation drive unit 23 so as to move the secondary transfer outer roller 9 to the standby position when standard toner patterns (toner pattern, detection pattern) formed as toner images on the intermediate transfer belt 20 pass through the secondary transfer nip portion T. That is, the abutment/separation control part 48 performs the following control in the case where the standard tonner pattern is formed in a region on the intermediate transfer belt corresponding to a region from a trailing edge of one recording material to a leading edge of a subsequent recording material in a recording material traveling direction. That is, the roller abutment/separation mechanism 21 and the abutment/separation drive unit 23 are controlled so as to move the secondary transfer outer roller 9 to the standby position (intermediate position) at a time when the standard toner pattern passes through the secondary transfer nip portion (secondary transfer portion) T. Thus, when the standard toner pattern passes through the secondary transfer nip portion T, the secondary transfer outer roller 9 can be separated from the secondary transfer inner roller 8 to be positioned at the standby position. Therefore, the inconvenience of contaminating the secondary transfer outer roller 9 with a toner image which is not secondarily transferred onto the recording material P can be prevented reliably.

The abutment/separation control part 48 controls the abutment/separation drive unit 23 so that both the movement of the secondary transfer outer roller 9 from the abutment position to the standby position and the movement of the secondary transfer outer roller 9 from the abutment position to the separation position are performed at the second moving speed. In this case, the moving speed at a time of separation which does not cause a load change to the intermediate transfer belt 20 can be set to the high second moving speed, and hence the secondary transfer outer roller 9 at the abutment position can be moved smoothly to the standby position and the separation position to be put in a standby state for the subsequent operation.

The control unit 51 forms a standard toner pattern forming a predetermined correction pattern set on the intermediate transfer belt 20 and performs an image correction operation. In general, when an intended image is formed, it is not necessary to correct the image. However, even when an image is formed based on the same image data, an image misalignment may occur due to a change in density of a toner image on the intermediate transfer belt or a change in a write position of each color, depending on a change in environment conditions such as temperature and humidity. A more stable image can be output by compensating for those inconveniences by the image correction control.

The correction execution determining part 52 of the control unit 51 determines whether or not correction is necessary based on the current passage number of the recording material P and the environment information such as the temperature and humidity on the periphery of the image forming apparatus 50.

The pattern forming part 53 forms the standard toner pattern forming the predetermined correction pattern set before or after a sheet-passage job of the recording material or between recording materials (sheets) during the continuous sheet-passage job in cooperation (coordination) with the image forming part when the correction execution determining part 52 determines that correction is necessary. The shape, color, density, number, and pattern region of the standard toner pattern forming the correction pattern set are stored as predetermined setting values.

As the standard tonner pattern, for example, there is given a density correction pattern in which respective colors having predetermined densities are arranged at predetermined intervals in a sub-scanning direction of the intermediate transfer belt 20. The density correction pattern is formed when the correction of density is performed. Further, there is a misalignment correction pattern in which a base color (Bk in this embodiment) overlaps correction colors (three colors of Y, M, and C in this embodiment). The misalignment correction pattern is formed when the correction of an image misalignment is performed. The correction pattern set is formed by combining these correction patterns.

In a full-color mode, both the density correction pattern and the misalignment correction pattern described above may be formed. However, in a monochromic mode, a color shift of each color caused by an image write misalignment does not occur, and hence only the density correction pattern is formed.

The pattern detecting part 54 detects the standard toner pattern formed on the intermediate transfer belt 20 with the pattern detection sensor 19.

The image correcting part 55 corrects image data (density, image write position) based on the detection data detected by the pattern detecting part 54.

Figure 2:
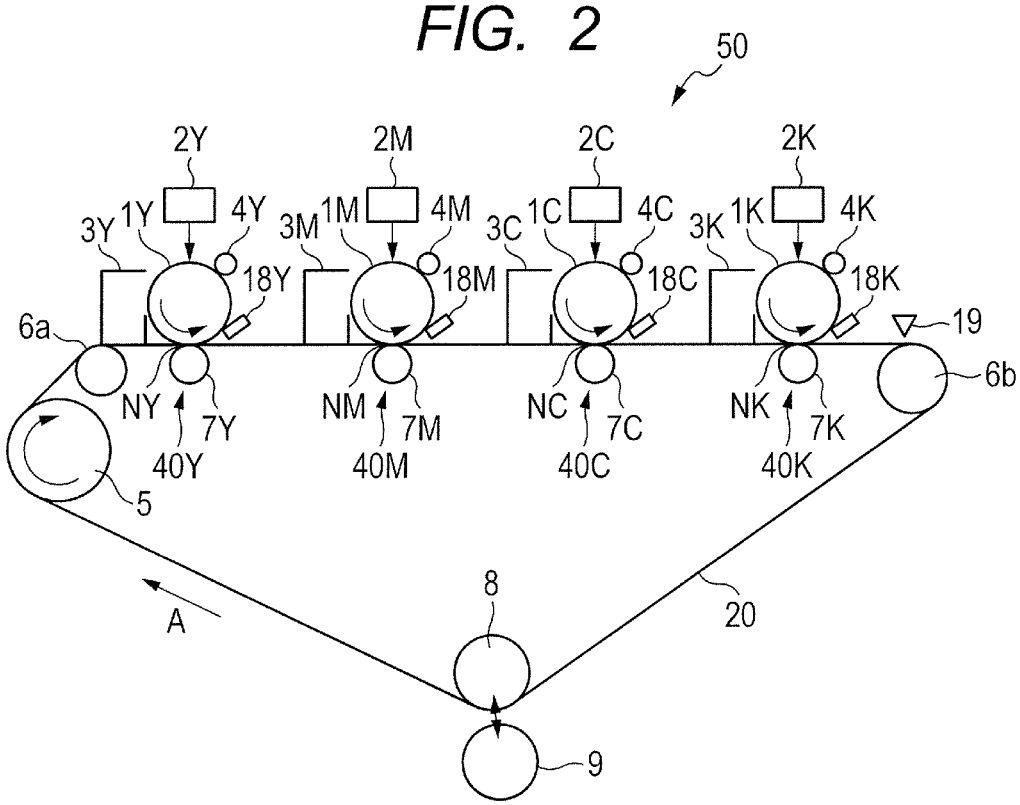
FIG. 2 is a schematic sectional view illustrating a state in which a secondary transfer outer roller of FIG. 1 is separated from an intermediate transfer belt.

The correction pattern set is not transferred onto the recording material P. Therefore, when the correction pattern set is formed in the same sequence as that during general sheet-passage image formation, the correction pattern set may contaminate the secondary transfer outer roller (secondary transfer rotary member) 9. Then, while the correction of an image is performed, the abutment/separation control part 48 controls the abutment/separation drive unit 23 to operate the eccentric cam 16 of the roller abutment/separation mechanism 21, thereby separating the secondary transfer outer roller 9 from the intermediate transfer belt (intermediate transfer member) 20 as illustrated in FIG. 2. Note that, the details of the roller abutment/separation mechanism 21 and the abutment/separation drive unit 23 are described later.

Next, the procedure of an operation for forming a standard toner pattern in this embodiment is briefly described.

First, the correction execution determining part 52 of the control unit 51 determines whether or not the correction of an image is performed in parallel with a printing operation using the image forming units 40Y to 40K. In this case, as the determination that the correction of an image is not performed in parallel with the printing operation, for example, there is a determination carried out with reference to an instruction given from a user through an operation unit (not shown) provided in the apparatus body.

The correction execution determining part 52 forms a standard toner pattern between sheets during the printing operation via the pattern forming part 53 and corrects an image with the image correcting part 55, in the case of determining that the correction of an image is performed in parallel with the printing operation. In this case, the productivity of printing processing can be prevented from being degraded by performing the printing operation, the formation of a standard toner pattern, and the control of the correction of an image in parallel.

[Load Change at Time of Abutment (Press-Contact) of Secondary Transfer Outer Roller]

In the image forming apparatus 50 according to this embodiment, the secondary transfer outer roller 9 is separated from the intermediate transfer belt 20 in the cases other than the case of secondarily transferring a toner image onto the recording material P. In the case of correcting an image between sheets, the primary transfer onto the intermediate transfer belt 20 or the exposure by the scanner units 2Y to 2K, or both of them may be performed simultaneously in some cases on the photosensitive drum of each color during a press-contact operation of the secondary transfer outer roller 9 so as to prevent the productivity from being degraded.

When a load change occurs in the intermediate transfer belt 20 due to the shock at a time when the secondary transfer outer roller 9 is brought into abutment against the intermediate transfer belt 20 during the image formation processing, an image misalignment or an image streak caused by the shock may occur in a toner image on the intermediate transfer belt.

[Abutment/Separation Configuration of Secondary Transfer Outer Roller]

Figure 3:
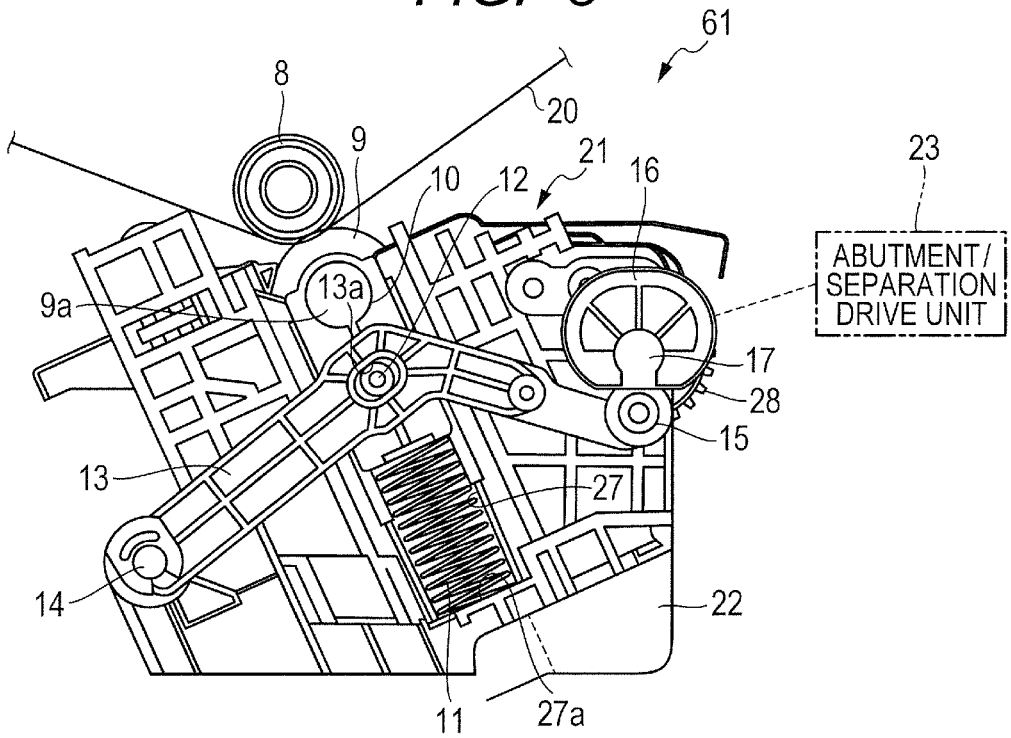
FIG. 3 is a sectional view illustrating a roller abutment/separation mechanism for bringing the secondary transfer outer roller into abutment against the intermediate transfer belt and separating the secondary transfer outer roller therefrom in the first embodiment.

In this embodiment, a problem such as the occurrence of an image streak is solved. Specifically, in this embodiment, the abutment/separation control part 48 controls the abutment/separation drive unit 23 for rotating the eccentric cam 16 of the roller abutment/separation mechanism 21 which brings the secondary transfer outer roller 9 into abutment against the secondary transfer inner roller 8 or separates the secondary transfer outer roller 9 from the secondary transfer inner roller 8. FIG. 3 is a sectional view illustrating the roller abutment/separation mechanism 21.

As illustrated in FIG. 3, the secondary transfer unit 61 removably mounted on the apparatus body 50*a* includes the secondary transfer outer roller 9, the roller abutment/separation mechanism 21 for moving the secondary transfer outer roller 9, and the abutment/separation drive unit 23. The roller abutment/separation mechanism 21 includes a support member 22 fixed to the apparatus body of the image forming apparatus 50 so as to be opposed to the secondary transfer inner roller 8. The support member 22 is provided with a secondary transfer arm 13 in a slightly bent shape so as to be positioned in a center portion. A rotation support hole 13*a* is formed in a center portion of the secondary transfer arm 13.

An accommodating unit 27, which is formed into a substantially linear shape so as to be directed to the secondary transfer inner roller 8, is formed in the support member 22. A roller holder 10 is accommodated in the accommodating unit 27 on a side close to the secondary transfer inner roller 8 so that a rotary shaft 9*a* can move and the roller holder 10 is regulated so as not to protrude to the secondary transfer inner roller 8 side further than the position illustrated in FIG. 3. On a side of the roller holder 10 opposite to the secondary transfer inner roller 8 in the accommodating unit 27, a holder bias spring 11 formed of a compression spring is provided so as to be contracted between a back end portion and a bottom portion 27*a* of the roller holder 10.

The roller holder 10 has a protrusion 12 protruding to a frontward side of FIG. 3. The protrusion 12 is slidably inserted in the rotation support hole 13*a* of the secondary transfer arm 13. A base end portion of the secondary transfer arm 13 is rotatably supported by the support member 22 at a rotation support shaft 14, and a rotatable pressured bearing member 15 in a disk shape is supported by a free end portion of the secondary transfer arm 13.

In the above-mentioned configuration, the secondary transfer outer roller 9 is brought into abutment against (press-contact with) the secondary transfer inner roller 8 due to bias force of the holder bias spring 11 while the rotation shaft 9*a* is held by the roller holder 10. The roller holder 10 and the secondary transfer outer roller 9 are formed so as to be movable in an abutment direction toward the secondary transfer inner roller 8 and in a separation direction separated from the secondary transfer inner roller 8 by the secondary transfer arm 13 held rotatably about the rotation support shaft 14. When the secondary transfer outer roller 9 moves in the abutment direction, the secondary transfer outer roller 9 is brought into abutment against the secondary transfer inner roller 8 so as to interpose the intermediate transfer belt 20 therebetween.

A cam support shaft 17 for supporting the eccentric cam 16 is arranged at a position on the support member 22, which is opposed to the pressured bearing member 15. The pressured bearing member 15 is brought into abutment against the eccentric cam 16, which is supported by the cam support shaft 17 with a center position being shifted, by the secondary transfer arm 13 whose center portion is biased with the holder bias spring 11.

The cam support shaft 17 rotates in response to the rotation from a DC motor 26 (FIG. 8) of the abutment/separation drive unit 23 to rotate the eccentric cam 16 under the state of being rotatably supported by the support member 22 while fixing and supporting the eccentric cam 16. The eccentric cam 16 changes a contact position (contact phase) with respect to the pressured bearing member 15 by rotating in response to the rotation from the DC motor 26 which is driven by the abutment/separation control part 48, with the result that the eccentric cam 16 moves the secondary transfer outer roller 9 among the abutment position, the separation position, and the standby position.

[Rotational Angle of Eccentric Cam and Position of Secondary Transfer Outer Roller]

Figure 4A:
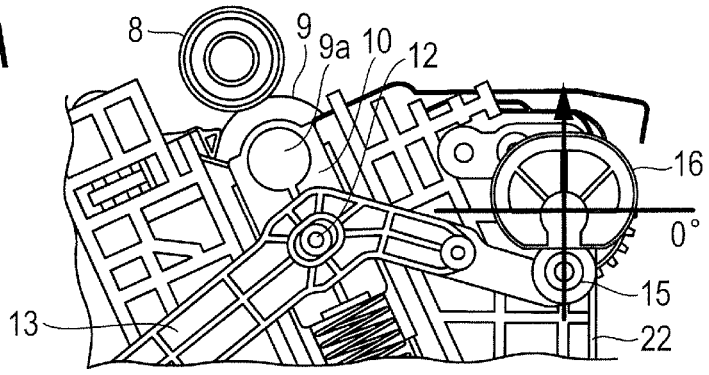
FIG. 4A is a sectional view illustrating an abutment position of the secondary transfer outer roller in the first embodiment.
Figure 4B:
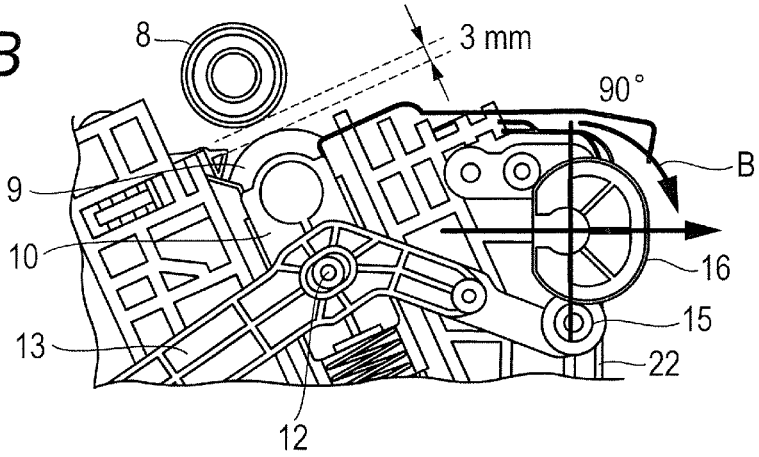
FIG. 4B is a sectional view illustrating a standby position of the secondary transfer outer roller.
Figure 4C:
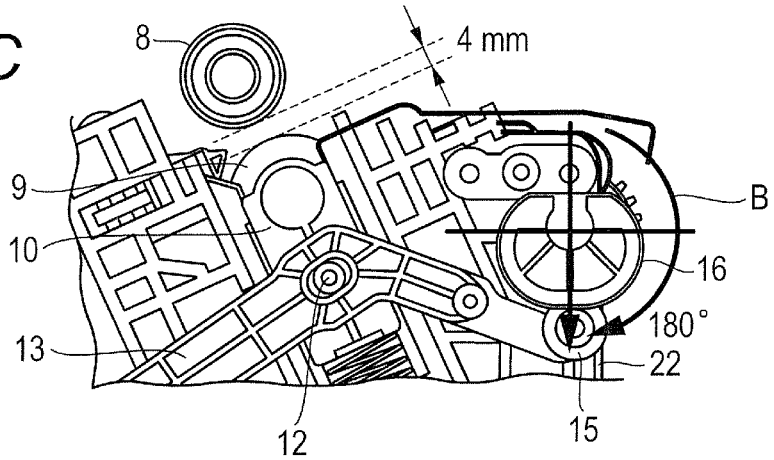
FIG. 4C is a sectional view illustrating a separation position of the secondary transfer outer roller.
Figure 5:
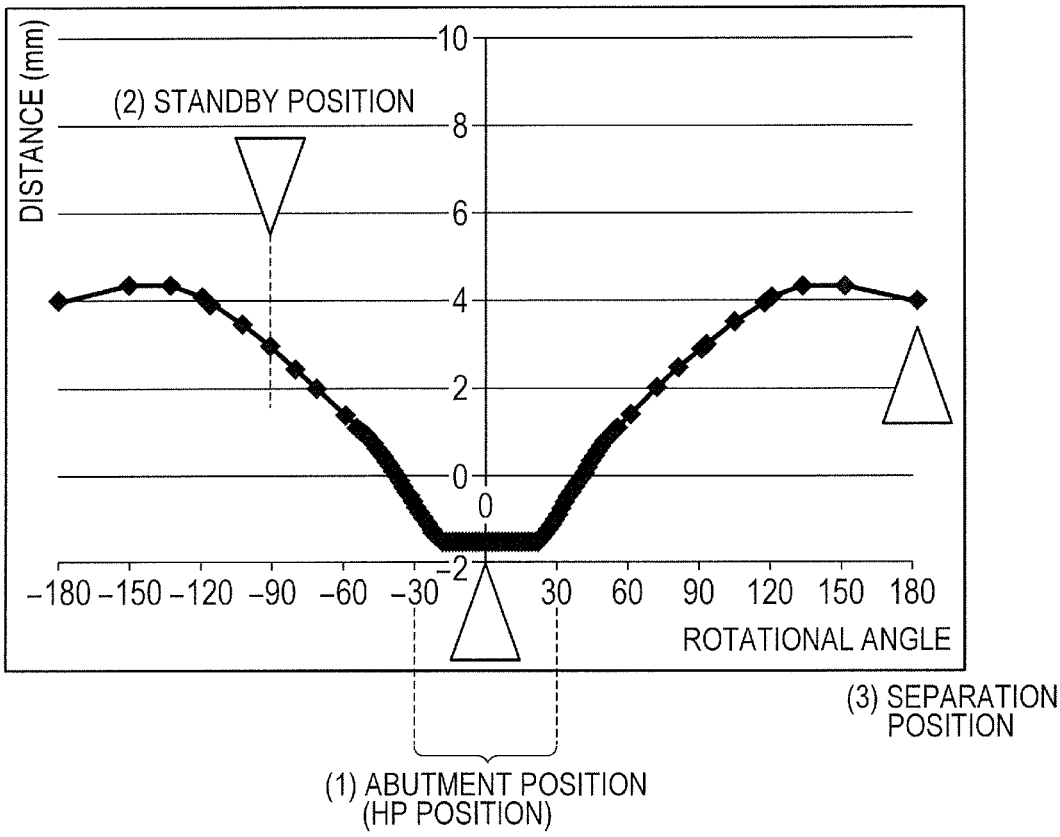
FIG. 5 is a graph showing a rotational angle of an eccentric cam and a separation amount of the secondary transfer outer roller in the first embodiment.

Next, the rotational angle of the eccentric cam 16 and the position of the secondary transfer outer roller 9 are described with reference to FIGS. 4A to 4C and 5. FIGS. 4A to 4C are schematic views illustrating the rotational angle of the eccentric cam 16 and the separation operation of the secondary transfer outer roller 9 in a state in which the intermediate transfer belt 20 is not shown. FIG. 5 is a graph showing a relationship between the rotational angle of the eccentric cam 16 and the separation amount (separation distance) with respect to the secondary transfer outer roller 9.

FIG. 4A illustrates a state in which the eccentric cam 16 is arranged at an initial position of a rotational angle of 0°, and the secondary transfer outer roller 9 is arranged at a position abutting against the secondary transfer inner roller 8 (see (1) Abutment position of FIG. 5).

FIG. 4B illustrates a state in which the eccentric cam 16 rotates by 90° in a direction of the arrow B, and the secondary transfer outer roller 9 is arranged at a position separated from the secondary transfer inner roller 8 (see (2) Standby position of FIG. 5). At the standby position, a distance between outer circumferential surfaces opposed to each other of the secondary transfer outer roller 9 and the secondary transfer inner roller 8 is set to, for example, 3 mm (which also applies to FIG. 6A).

FIG. 4C illustrates a state in which the eccentric cam 16 rotates by 180° in the direction of the arrow B, and the secondary transfer outer roller 9 is arranged at a position separated from the secondary transfer inner roller 8 (see (3) separation position of FIG. 5). At the separation position, a distance between outer circumferential surfaces opposed to each other of the secondary transfer outer roller 9 and the secondary transfer inner roller 8 is set to, for example, 4 mm (which also applies to FIG. 6B).

When the expression of each position is rephrased, the "abutment position" is a position when the secondary transfer is performed during printing (abutment position during a job). The "standby position" is a position at which the secondary transfer outer roller 9 is separated from the secondary transfer inner roller 8 when a standard toner pattern (correction patch) is formed on the intermediate transfer belt during printing (separation position during a job). The "separation position" is a position at which the secondary transfer outer roller 9 is separated from the secondary transfer inner roller 8 during the periods other than the printing (separation position during standby (motor off)). At the "standby position", the secondary transfer outer roller 9 is separated from the secondary transfer inner roller 8 only at a distance at least required so as to prevent the correction patch from adhering to the secondary transfer outer roller 9 side when the correction patch passes. At the "separation position", the secondary transfer outer roller 9 is separated from the secondary transfer inner roller 8 only at a distance considering the processability of paper jam and the inserting and extracting performance (inserting and extracting property) of the secondary transfer unit 61 during maintenance with respect to the apparatus body 50*a* (see FIGS. 1 and 3).

Next, a process of moving the secondary transfer outer roller 9 from the separation position to the abutment position in the above-mentioned configuration is described with reference to FIG. 5.

Figure 8:
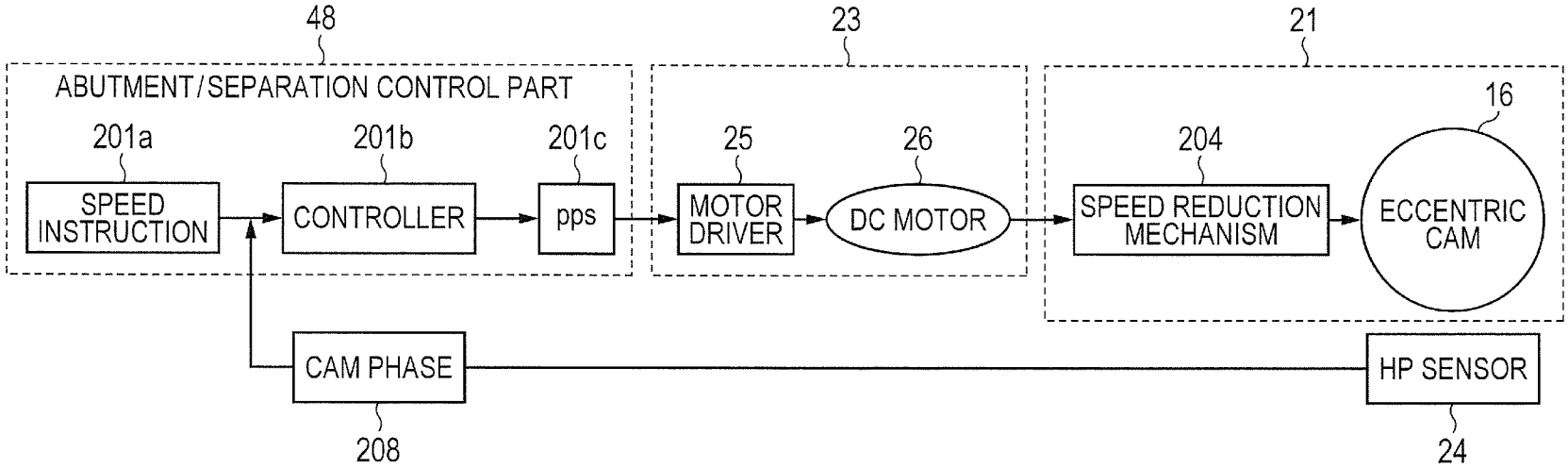
FIG. 8 is a block diagram illustrating an internal configuration of an abutment/separation drive unit of the secondary transfer outer roller in the first embodiment.

The abutment/separation control part 48 detects the position of the secondary transfer outer roller 9 based on the detection of a phase of the eccentric cam 16 by an HP sensor 24 (see FIG. 8). The detection by the HP sensor 24 is performed at the abutment position so as to ensure the position of the secondary transfer outer roller 9 during secondary transfer. That is, the abutment position of the secondary transfer outer roller 9 is a home position. Therefore, the secondary transfer outer roller 9 at the separation position moves to the standby position once via the abutment position and moves to the abutment position after a printing job is input.

Figure 6A:
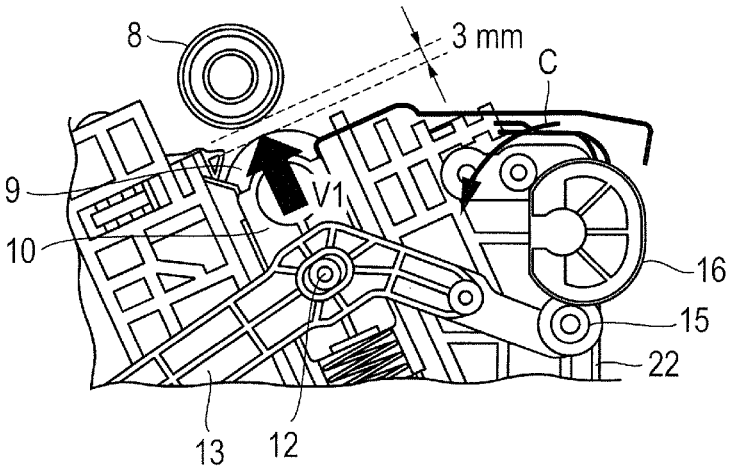
FIG. 6A is a schematic view illustrating the comparison of moving speeds of the secondary transfer outer roller in the first embodiment.
Figure 6B:
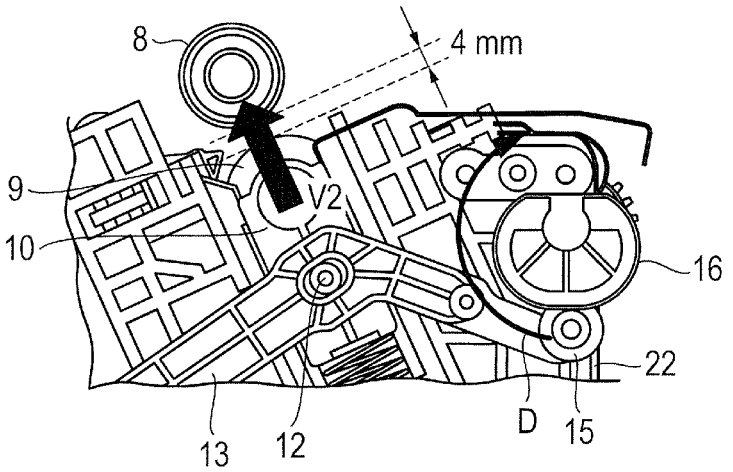
FIG. 6B is a schematic view illustrating the comparison of moving speeds of the secondary transfer outer roller in the first embodiment.

Next, the moving speed of the secondary transfer outer roller 9 in this embodiment is described with reference to FIGS. 6A and 6B. FIGS. 6A and 6B are schematic views illustrating the moving speed of the secondary transfer outer roller 9 in this embodiment.

The load change caused when the secondary transfer outer roller 9 is brought into abutment against the intermediate transfer belt 20 during image formation becomes a factor for image defects. Then, in the case of the exposure and the primary transfer, when the secondary transfer outer roller 9 is moved from the "standby position" of FIG. 6A to the "abutment position" where the secondary transfer outer roller 9 is brought into abutment against the secondary transfer inner roller 8, the secondary transfer outer roller 9 is moved as follows. That is, the moving speed V1 (first moving speed) of the secondary transfer outer roller 9 is set to be lower than the moving speed V2 (second moving speed) in the cases other than the exposure and the primary transfer so as to alleviate shock.

Figure 7A:
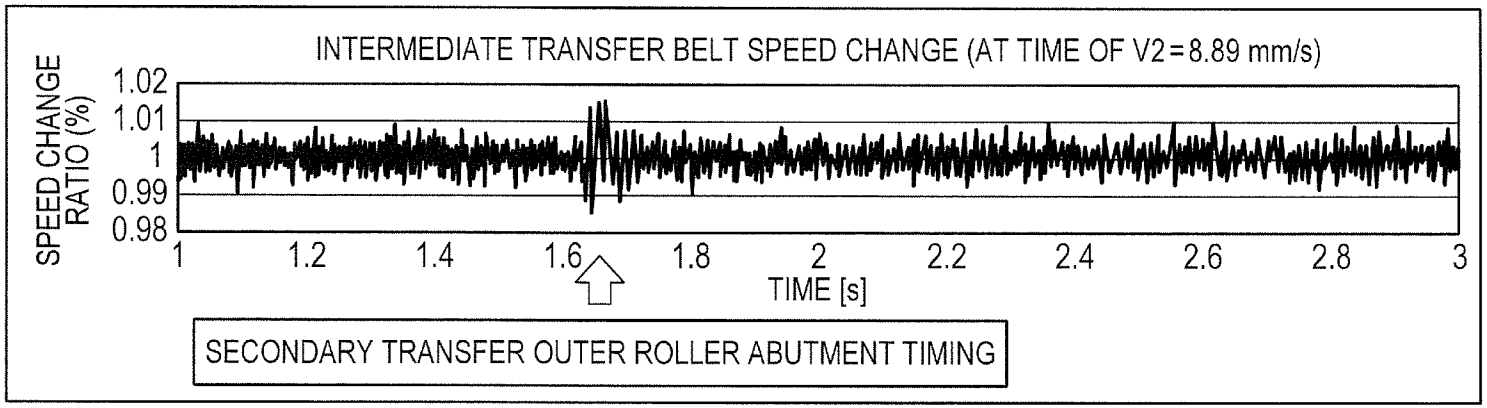
FIG. 7A is a graph showing a speed change when the secondary transfer outer roller in the first embodiment is brought into abutment against the intermediate transfer belt at a second moving speed.
Figure 7B:
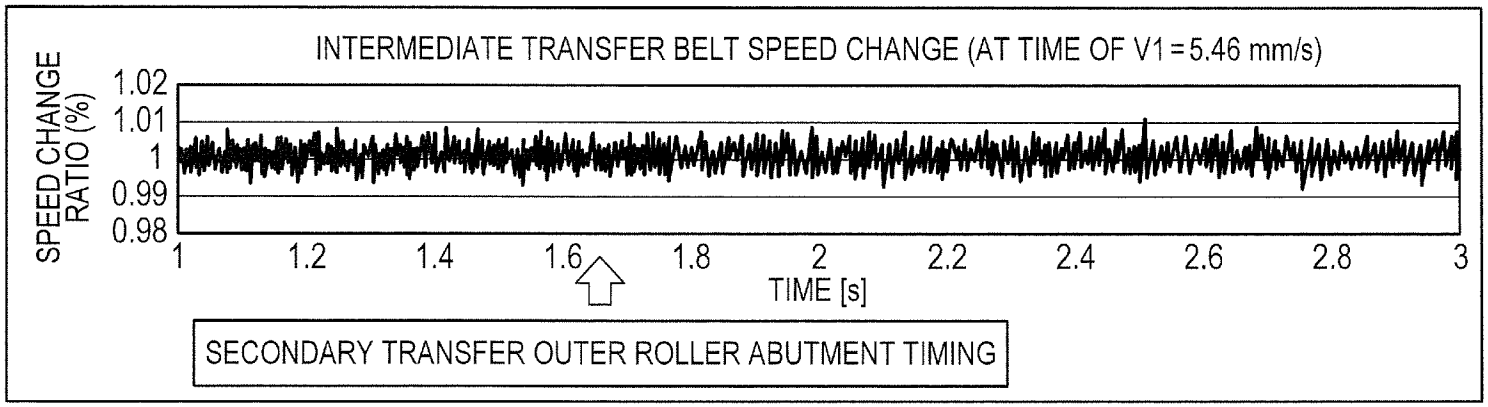
FIG. 7B is a graph showing a speed change when the secondary transfer outer roller in the first embodiment is brought into abutment against the intermediate transfer belt at a first moving speed.

Specifically, the moving speed V2 (second moving speed) can be set to 8.89 mm/s, and the moving speed V1 (first moving speed) can be set to 5.46 mm/s. FIGS. 7A and 7B show measurement results of a speed change occurring in the intermediate transfer belt 20 in the case where the secondary transfer outer roller 9 is moved from the "standby position" to the "abutment position" at each speed so as to be brought into abutment against the secondary transfer inner roller 8.

When the abutment (press-contact) is performed at the moving speed V2, a large change occurs at a timing of the abutment of the secondary transfer outer roller indicated by the arrow as shown in FIG. 7A. In contrast, it is understood from FIG. 7B that, in the case where the abutment of the secondary transfer outer roller 9 is performed at the moving speed V1, a speed change as shown in FIG. 7A is significantly reduced.

Next, the control configuration of the abutment/separation drive unit 23 (see FIGS. 1 and 3) in this embodiment is described with reference to FIG. 8. FIG. 8 is a block diagram illustrating configurations of the abutment/separation drive unit 23 for bringing the secondary transfer outer roller 9 into abutment against the secondary transfer inner roller 8 or separating the secondary transfer outer roller 9 from the secondary transfer inner roller 8 and the abutment/separation control part 48 for controlling the abutment/separation drive unit 23.

The abutment/separation control part 48 includes a controller 201*b* for receiving a speed instruction (rotational speed instruction) 201*a* and sending a pulse speed (pps) 201*c*. The abutment/separation control part 48 determines the amount of energy supplied to the DC motor 26 by general pulse control based on the speed instruction (rotational speed instruction) 201*a* varying depending on a sequence, which is given by a CPU included in a host controller (not shown). The abutment/separation control part 48 determines the rotational direction of the DC motor 26 based on a cam phase 208 of the eccentric cam 16 obtained by the HP sensor 24.

The abutment/separation drive unit 23 includes a motor driver 25 and the DC motor 26. The roller abutment/separation mechanism 21 includes a speed reduction mechanism 204 including a gear 28 (see FIG. 3), and the eccentric cam 16. The rotation of the DC motor 26 driven via the motor driver 25 is reduced by the speed reduction mechanism 204 and transmitted to the eccentric cam 16.

That is, the roller abutment/separation mechanism includes the eccentric cam 16 which is driven and rotated by the DC motor 26 formed of a pulse motor. The eccentric cam 16 moves the secondary transfer outer roller 9 to any of the abutment position, the separation position, and the standby position due to the rotational position based on the control of the abutment/separation control part 48. Therefore, the rotational position of the eccentric cam 16 can be change only by changing a pulse signal with respect to the DC motor 26 with the control of the abutment/separation control part 48 so that the position of the secondary transfer outer roller 9 can be changed simply and accurately.

The home position (HP) of the rotating eccentric cam 16 is detected by the HP sensor 24, and a signal serving as the cam phase 208 based on the detected signal is added to the speed instruction (rotational speed instruction) 201*a*.

The DC motor 26 can be formed of a pulse motor. In this case, the roller abutment/separation mechanism 21 and the abutment/separation drive unit 23 serving as the moving unit include a pulse motor (26) for moving the secondary transfer outer roller 9, and the abutment/separation control part 48 controls the moving speed of the secondary transfer outer roller 9 by changing a pulse to be supplied to the pulse motor (26). Thus, the moving speed of the secondary transfer outer roller 9 can be easily changed by changing a pulse signal with the abutment/separation control part 48.

Figure 9:
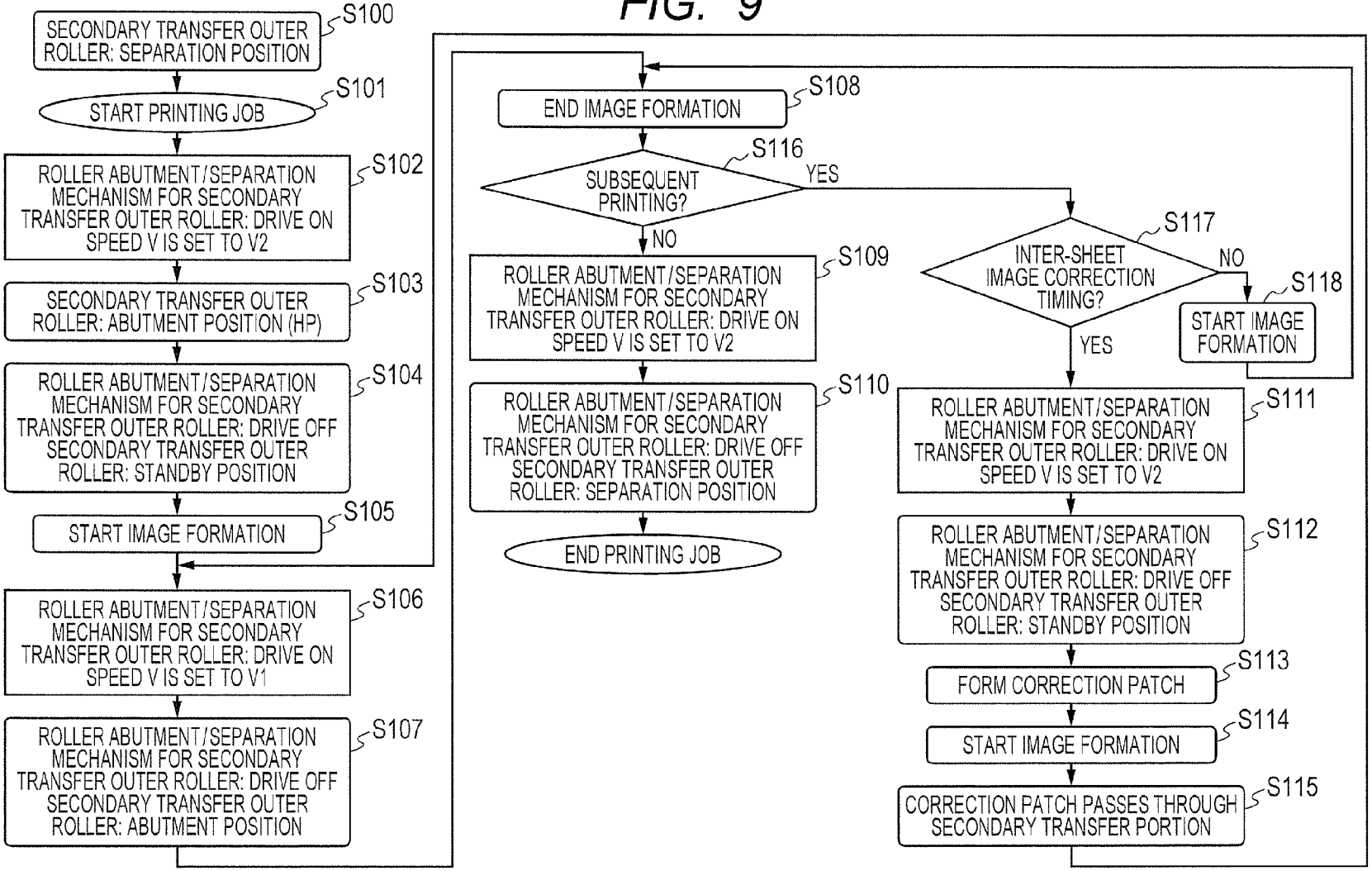
FIG. 9 is a flow chart illustrating a mounting/removal operation of the secondary transfer outer roller in the first embodiment.
Figure 10:
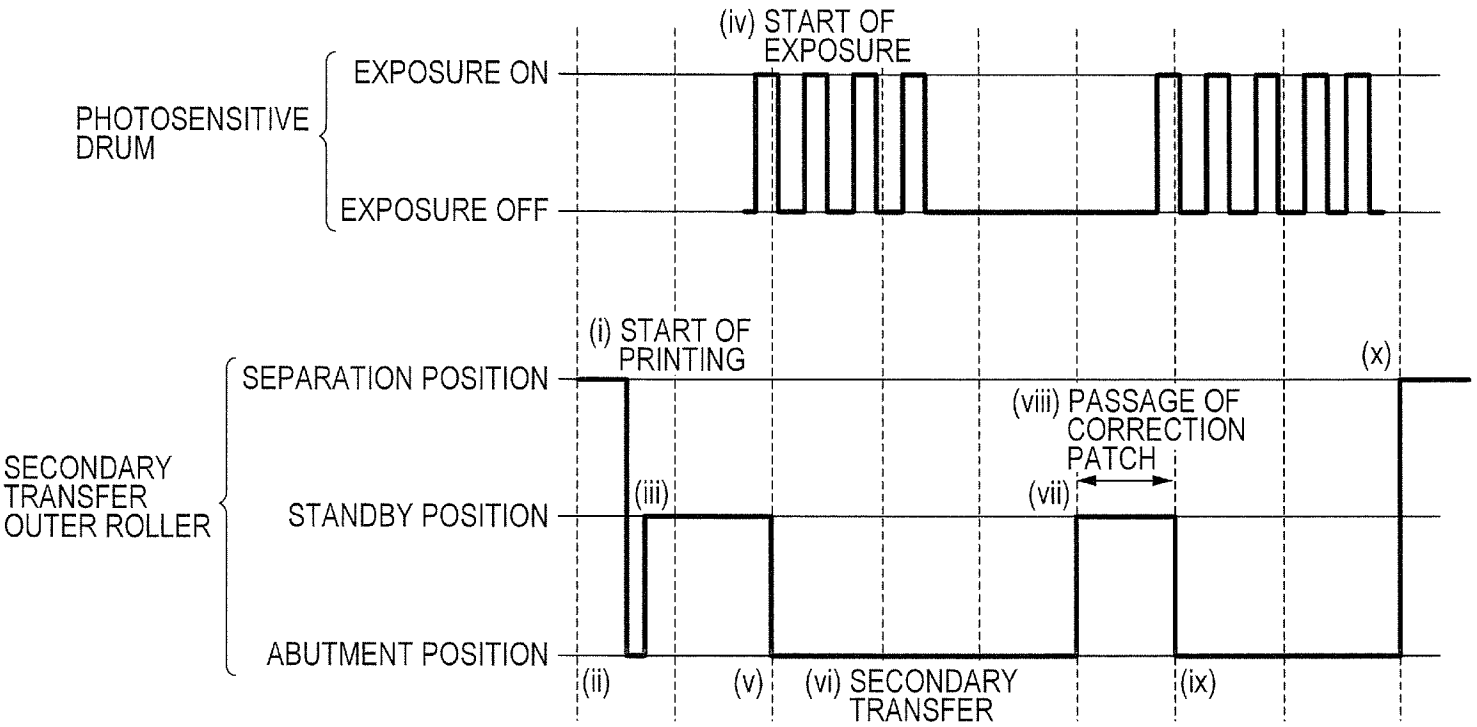
FIG. 10 is a timing chart illustrating a mounting/removal operation of the secondary transfer outer roller in the first embodiment.

Next, the movement of the secondary transfer outer roller 9 during printing and the timing for moving the secondary transfer outer roller to the separation position, the standby position, or the abutment position in this embodiment are described with reference to FIGS. 9 and 10. FIG. 9 is a flow chart regarding the movement of the secondary transfer outer roller 9. FIG. 10 is a timing chart illustrating a timing for moving the secondary transfer outer roller 9 to the separation position, the standby position, or the abutment position.

In Step S100, the secondary transfer outer roller 9 is at the separation position during the periods other than the printing. A printing job is started in response to an instruction of starting printing input from the operation unit (not shown) provided in the apparatus body (S101, (i) of FIG. 10). In this case, the period is other than the exposure period and the primary transfer period, and hence, in Step S102, the abutment/separation control part 48 sets the moving speed V by the roller abutment/separation mechanism 21 to V2 (V=V2) (where V1<V2).

Then, when the secondary transfer outer roller 9 moves to the abutment position, the HP sensor 24 (see FIG. 8) detects the phase of the eccentric cam 16 (S103, (ii) of FIG. 10). The abutment/separation control part 48 confirms that the secondary transfer outer roller 9 is positioned at the abutment position and interposes the intermediate transfer belt 20 together with the secondary transfer inner roller 8, based on the detection.

After that, the exposure of the photosensitive drums 1Y to 1K by the scanner units 2Y to 2K is started ((iv) of FIG. 10). Then, the secondary transfer outer roller 9 moves to the standby position until toner images primarily transferred onto the intermediate transfer belt during primary transfer reach the secondary transfer portion (T) (S104, (iii) of FIG. 10).

In this case, the exposure of the photosensitive drums 1Y to 1K (S105, (iv) of FIG. 10), the change of the moving speed V by the roller abutment/separation mechanism 21 to V1 (S106), and the abutment of the secondary transfer outer roller 9 (S107, (v) of FIG. 10) are performed in this order.

The toner images are secondarily transferred onto a recording material via the intermediate transfer belt 20 (S108). In the case where there is no subsequent printing (NO in S116), the abutment/separation control part 48 sets the moving speed V by the roller abutment/separation mechanism 21 to V2 (S109), and thereafter moves the secondary transfer outer roller 9 to the separation position (S110). The image forming part 47 finishes the printing job after the completion of the movement of the secondary transfer outer roller 9.

In the case where there is subsequent printing in S116 (YES in S116), the correction execution determining part 52 determines whether or not it is timing for performing inter-sheet image correction (S117). As a result, in the case where the correction execution determining part 52 determines that inter-sheet image correction is not performed (NO in S117), the image forming part 47 performs image formation of a subsequent printing image in Step S118, and then the process proceeds to Step S108.

On the other hand, in the case where the correction execution determining part 52 determines that inter-sheet image correction is executed (YES in S117), the abutment/separation control part 48 sets the moving speed V by the roller abutment/separation mechanism 21 to V2 (S111) and moves the secondary transfer outer roller 9 to the standby position at the moving speed V2 (S112, (vii) of FIG. 10).

After the completion of the movement to the standby position, the correction execution determining part 52 executes image formation of a correction patch (standard toner pattern) (S113), and executes image formation of a subsequent printing image (S114).

After the correction patch passes through the secondary transfer portion (T) (S115), the abutment/separation control part 48 sets the moving speed V by the roller abutment/separation mechanism 21 to V1 (S106) and moves the secondary transfer outer roller 9 to the abutment position (S107).

After the completion of the abutment of the secondary transfer outer roller 9 with respect to the intermediate transfer belt 20, the exposure of the subsequent printing image started in Step S114 is completed (S108), and this image is secondarily transferred onto a recording material via the intermediate transfer belt 20.

In the above-mentioned embodiment, the abutment/separation control part 48 controls the first moving speed V1 at which the secondary transfer outer roller 9 is brought into abutment against the intermediate transfer belt 20 during image formation using at least one of the scanner units 2Y to 2K and the primary transfer nip portions NY to NK as follows. That is, the roller abutment/separation mechanism 21 and the abutment/separation drive unit 23 are controlled so as to set the first moving speed V1 to be lower than the second moving speed V2 at which the secondary transfer outer roller 9 is brought into abutment against the intermediate transfer belt 20 from the separation position in the cases other than the image formation. Thus, a load change at a time of abutment of the secondary transfer outer roller 9 against the intermediate transfer belt 20 is reduced during the image formation, and the secondary transfer outer roller 9 is brought into abutment against the intermediate transfer belt 20 rapidly during the periods other than the image formation, with the result that the degradation in productivity due to the time period required for the abutment operation of the secondary transfer outer roller 9 can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-195151, filed Sep. 20, 2013, which is hereby incorporated by reference herein in its entirety.

What is claimed is:

1. An image forming apparatus, comprising:

a rotatable photosensitive member;

an exposure unit exposing the photosensitive member, which has been charged, so as to form a latent image;

a developing unit developing the latent image formed on the photosensitive drum so as to form a toner image;

a movable intermediate transfer member;

a primary transfer roller primarily transferring the toner image, which is formed on the photosensitive member, from the photosensitive member onto the intermediate transfer member in a primary transfer portion in which the intermediate transfer member is brought into abutment against the photosensitive member;

a secondary transfer unit having a secondary transfer roller that secondarily transfers the toner image, which is primarily transferred onto the intermediate transfer member, onto a recording material in a secondary transfer portion in which the secondary transfer roller is brought into abutment against the intermediate transfer member, the secondary transfer unit capable of being brought into abutment against and separated from the intermediate transfer member, and capable of being removed from and mounted on an apparatus body while being separated from the intermediate transfer member;

a moving mechanism moving the secondary transfer unit to an abutment position, a separation position and an intermediate position under a state in which the secondary transfer unit is mounted on the apparatus body, wherein the secondary transfer unit is brought into abutment against the intermediate transfer member in the abutment position, the secondary transfer unit is capable of being removed from and mounted on the apparatus body in the separation position, the secondary transfer unit is separated from the intermediate transfer member in the separation position, and the intermediate position is between the separation position and the abutment position; and a control unit configured to control the moving mechanism so as to cause the secondary transfer unit to move from the intermediate position to the abutment position at a first moving speed in a case where the secondary transfer unit is to be brought into abutment against the intermediate transfer member during at least one of an exposure period and a primary transfer period, and to cause the secondary transfer unit to move from the separation position to the abutment position at a second moving speed higher than the first moving speed in a case where the secondary transfer unit is to be brought into abutment against the intermediate transfer member during a period other than the exposure period and the primary transfer period.

2. An image forming apparatus according to claim 1, wherein the control unit is configured to control the moving mechanism, in a case where a toner pattern is formed in a region on the intermediate transfer member corresponding to a region from a trailing edge of one recording material to a leading edge of a subsequent recording material in a traveling direction of the recording material during continuous image formation, so as to cause the secondary transfer unit to move to the intermediate position when the toner pattern passes through the secondary transfer portion.

3. An image forming apparatus according to claim 1, wherein the moving mechanism has a pulse motor which moves the secondary transfer unit, and wherein the control unit controls the moving mechanism by changing a pulse to be supplied to the pulse motor to change a moving speed of the secondary transfer unit.

4. An image forming apparatus according to claim 3, wherein the moving mechanism has an eccentric cam which is rotationally driven with the pulse motor, and wherein the control unit causes the secondary transfer unit to move to any of the abutment position, the intermediate position, and the separation position by controlling the pulse of the pulse motor to change a rotational position of the eccentric cam.

5. An image forming apparatus according to claim 3, wherein the control unit is configured to control the moving mechanism so as to cause the secondary transfer unit to move from the abutment position to the intermediate position at the second moving speed, and to move from the abutment position to the separation position at the second moving speed.

* * * * *